US006311343B1

(12) United States Patent
Wisniewski

(10) Patent No.: US 6,311,343 B1
(45) Date of Patent: Nov. 6, 2001

(54) SWIMMING POOL LOUNGE CHAIR

(76) Inventor: Mark Wisniewski, 27177 Crocker, Harrison Township, MI (US) 48048

( * ) Notice: Subject to any disclaimer, the term of this patent is extended or adjusted under 35 U.S.C. 154(b) by 0 days.

(21) Appl. No.: 09/677,465

(22) Filed: Sep. 29, 2000

Related U.S. Application Data

(60) Provisional application No. 60/157,270, filed on Oct. 1, 1999.

(51) Int. Cl.[7] ..... E04H 4/14
(52) U.S. Cl. ..... 4/496; 4/578.1
(58) Field of Search ..... 4/578.1, 579, 496

(56) References Cited

U.S. PATENT DOCUMENTS

| | | | | |
|---|---|---|---|---|
| 2,322,147 | * | 6/1943 | Landauer | 4/579 X |
| 3,072,923 | * | 1/1963 | Zuke | 4/579 X |
| 3,290,090 | * | 12/1966 | Ford | 4/578.1 X |
| 4,837,869 | | 6/1989 | Simmon | 4/496 |
| 5,307,527 | | 5/1994 | Schober | 4/496 |
| 5,860,171 | | 1/1999 | Hicks | 4/496 |
| 6,094,756 | * | 8/2000 | Carter | 4/578.1 |

FOREIGN PATENT DOCUMENTS

| | | | | |
|---|---|---|---|---|
| 544131 | * | 10/1930 | (DE) | 4/579 |

* cited by examiner

*Primary Examiner*—Robert M. Fetsuga
(74) *Attorney, Agent, or Firm*—Harness, Dickey & Pierce, P.L.C.

(57) ABSTRACT

A swimming pool lounge chair is provided for use in an above ground or in-ground swimming pool to provide stationary seating for the occupant. The swimming pool lounge chair has a reclining back portion, telescopically adjustable legs to rest on the bottom of the pool at the option of the user, and a pool perimeter mounting portion that is also telescopically adjustable to permit the user to adjust his or her level of submersion in the pool. The chair is collapsible, portable, and is not permanently affixed to or within the swimming pool.

8 Claims, 2 Drawing Sheets

FIG. 1.
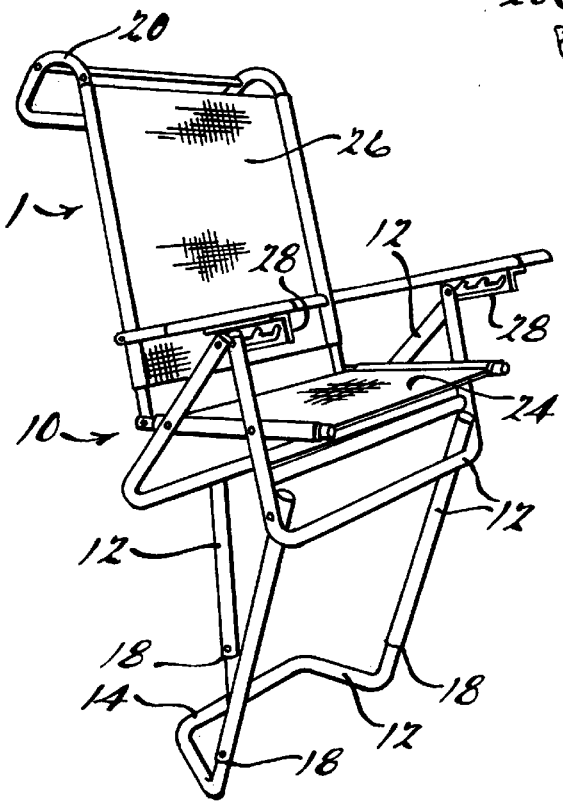
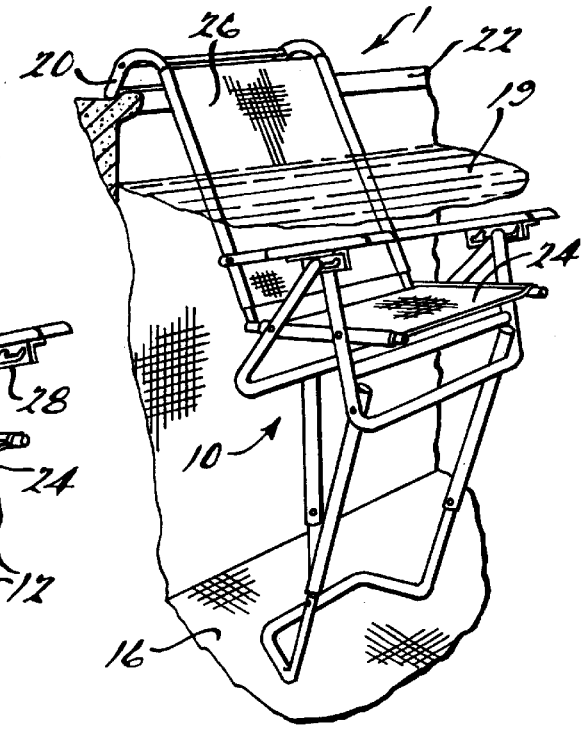
FIG. 4.
FIG. 3.
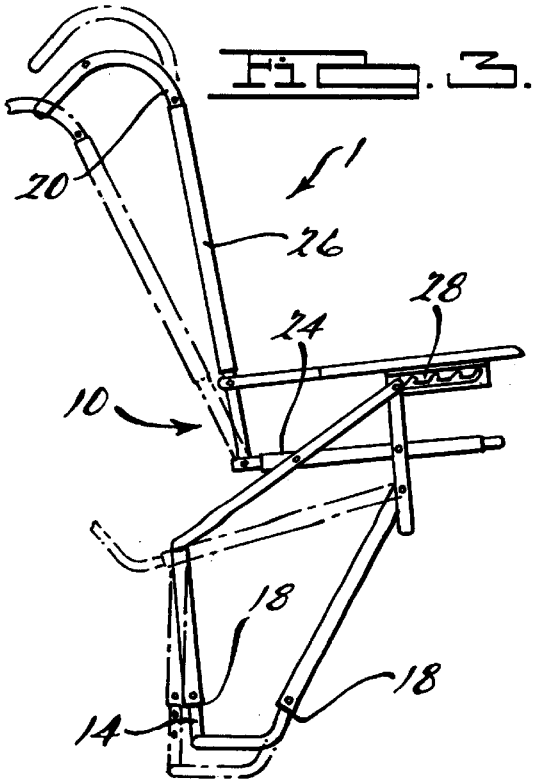
FIG. 2.
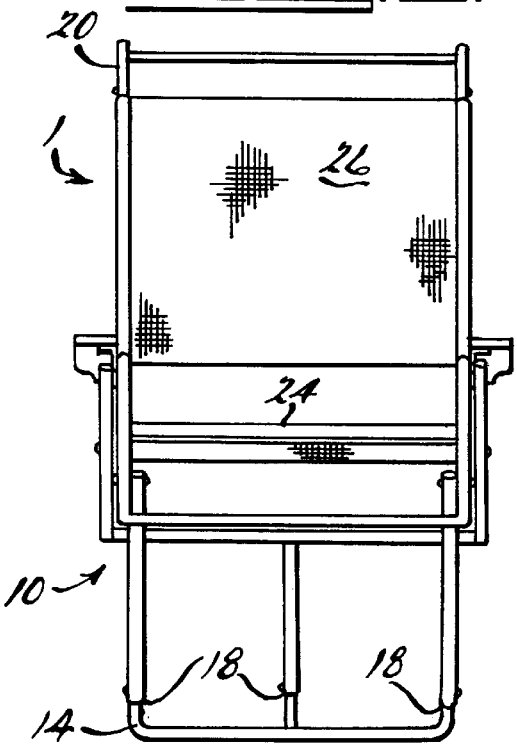

SWIMMING POOL LOUNGE CHAIR

This Application claims benefit of provisional application Ser. No. 60/157 270 filed Oct. 1, 1999.

BACKGROUND

The present invention relates to swimming pool accessories and, in particular, a lounge chair for use in a swimming pool, spa, or other aquatic body which enables the user to sit and/or recline in a stationary manner in the chair with his body at least partially submerged in the water.

There are a wide variety of swimming pool accessories including floatation devices which allow an individual to recline in a chair and float freely on the water with his body partially submerged in the water. Other swimming pool chairs enable the user to sit in a more upright position while still being submerged in the pool water but allowing the person's head and/or upper torso to be above the water surface. Some of these pool chairs utilize the pool structure, itself, as a means to support the chair in the operable position and/or are permanently affixed within the swimming pool and may not be easily removed and used elsewhere.

SUMMARY OF THE INVENTION

It is a principle object of the present invention to provide a lounge chair for use in swimming pools which may be positioned about the perimeter edge of the pool and which utilizes adjustable support legs in combination with an adjustable pool perimeter mounting portion to provide a stationary seating unit to enable a user to be partially submerged within the pool water, yet maintain his torso and/or head above the pool water level. The adjustable support legs enable the pool chair to be supported on the bottom surface of the pool. The user may also adjust the support legs to a desired height to enable him to control the depth at which he is submerged in the pool water. Similarly, the pool perimeter mounting portion may be adjustable to control the user's submerged depth. In addition, the swimming pool lounge chair of the present invention allows the user to adjust the angle of inclination of the seat back, as desired. The combination of the adjustable reclining feature, adjustable support legs, and pool perimeter mounting portion of the present invention enables the user to select from a wide variety of adjusted positions so that his desired level of submersion can be accommodated.

The swimming pool lounge chair of the present invention is adapted to be partially submerged in the water of the swimming pool. It includes a frame constructed of a plurality of light-weight tubular members. The chair includes a generally horizontal seating surface and a generally vertical back support surface. The back support surface may be adjusted to a variety of angles of inclination. The frame includes a base portion which can be adapted to support the chair on the bottom of the pool. The base portion has adjustable legs which may be telescopically extended or retracted to vary the height of the chair within the pool water and/or to accommodate different pool depths. The frame also includes a pool perimeter mounting portion which enables the chair to be supported at its upper end at the perimeter of the swimming pool. The pool perimeter mounting portion may also be adjustable to alter the submerged depth of the swimming pool lounge chair. The swimming pool lounge chair of the present invention is equally adaptable for use in above-ground as well as below-ground swimming pools. The swimming pool lounge chair of the present invention may be manufactured from light-weight tubular materials.

The chair is collapsible, portable, and is not permanently affixed to or within the swimming pool. Consequently, it may be removed from the swimming pool when not in use and/or transported from one swimming pool to another swimming pool by the user with little effort.

BRIEF DESCRIPTION OF THE DRAWINGS

FIG. 1 is a perspective view of the swimming pool lounge chair of the present invention;

FIG. 2 is a front view of the swimming pool lounge chair of FIG. 1;

FIG. 3 is a side view of the swimming pool lounge chair of FIG. 1 showing the adjustability features of the chair in phantom;

FIG. 4 is a perspective view of the swimming pool lounge chair of FIG. 1 as placed in use in a below-ground swimming pool;

DESCRIPTION OF THE PREFERRED EMBODIMENT

Figure 5:
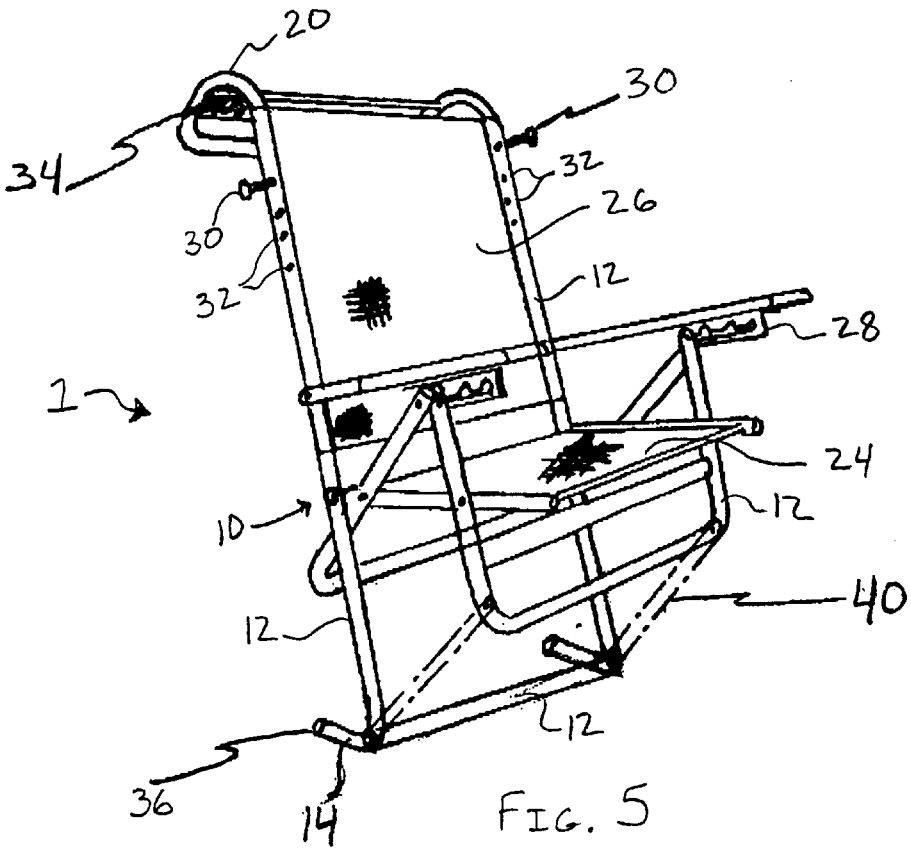
FIG. 5 is a perspective view of another embodiment of the swimming pool lounge chair showing additional, optional leg supports.
Figure 6:
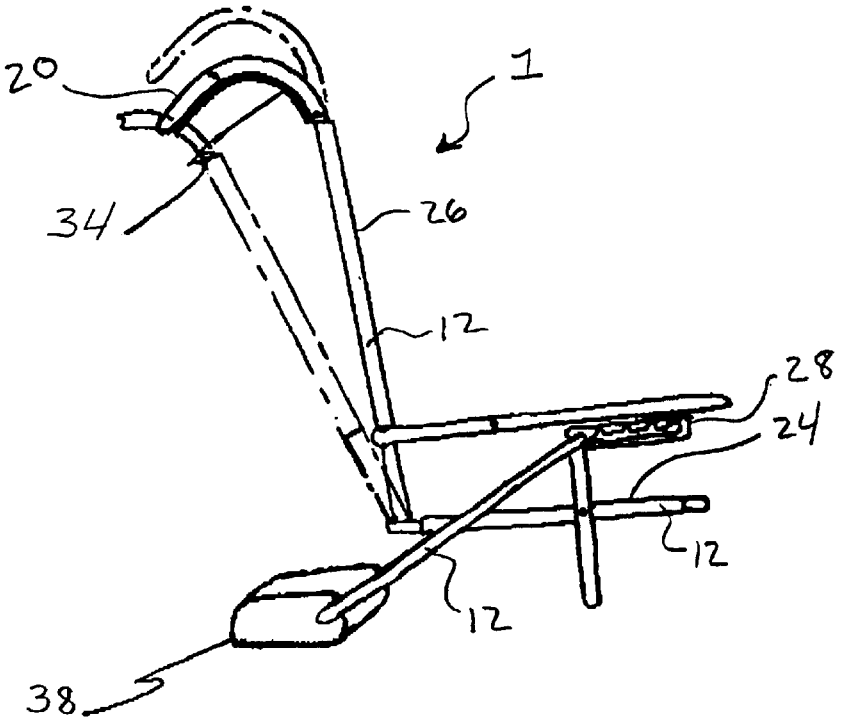
FIG. 6 is a perspective view of another embodiment of the swimming pool lounge chair showing a bumper spacer on the bottom, rearward legs.

Referring now to the Figures, the swimming pool lounge chair (1) of the present invention includes a frame (10) which is constructed from a plurality of light-weight tubular-type frame members (12) and may be manufactured from materials such as aluminum or plastic. A base portion (14) of the frame (10) may be adapted to rest on the bottom, sides, or other structure or portion of a swimming pool (16) and support the swimming pool lounge chair (1). As shown in FIG. 3, the base portion (14) includes a plurality of adjustable telescoping legs (18) which extend generally vertically to enable the swimming pool lounge chair (1) to accommodate different depths of swimming pools, as well as to adjust the depth at which the swimming pool lounge chair (1) is submerged in the pool water (19). At an upper end of the frame (10) there is a pool perimeter mounting portion (20) which may be used to support the swimming pool lounge chair (1) about the perimeter of the swimming pool (22) into which it is placed for use. The pool perimeter mounting portion (20) may be used with either a below-ground swimming pool or an above-ground swimming pool to support the upper portion of the swimming pool lounge chair (1). When in use, the pool perimeter mounting portion (20) adequately secures the swimming pool lounge chair in a stationary position in the pool. In FIG. 5, the pool perimeter mounting portion (20) shows an optional friction or gripping material (34) to further secure the swimming pool lounge chair (1) in-place. Rubber tips (36) are also provided on the ends of the frame members (12) to assist in generating friction to hold the swimming pool lounge chair (1) in-place. The pool perimeter mounting portion (20) may, like the legs (18), be telescopically adjusted to adapt to different swimming pools and/or vary the submerged depth of the user. FIG. 5 shows the adjustability of the pool perimeter mounting portion (20) by removing the back pins (30) from holes (32) and then either raising or lowering the pool perimeter mounting portion (20) before replacing the back pins (30). Furthermore, to simplify the adjustment process, the swimming pool lounge chair of FIG. 6 is equipped with a bumper spacer (38) to rest against the swimming pool wall regardless of the adjusted position of the pool perimeter mounting portion (20).

The swimming pool lounge chair (1) includes a generally horizontal seating surface (24) and a generally vertical back support surface (26). The back support surface (26) is pivotally reclinable (as shown in FIG. 3) to a variety of inclined positions by way of adjustment brackets (28). The seating surfaces (24) and (26) may be manufactured from any of a variety of known suitable materials, such as polyester or vinyl, to name a few.

The swimming pool lounge chair (1) is not permanently mounted or affixed to the swimming pool and, due to its light-weight design, may be easily placed in operation and removed from use. Also, it may be moved from location to location about the swimming pool, as desired. Further, the swimming pool lounge chair (1) is convertible to a collapsed configuration while not in use, such as during periods of storage or transport.

It should be understood that while the foregoing discussion illustrates a particular embodiment of the present invention, this embodiment merely represents a best mode of currently practicing the invention, and various other modifications and advantages will become apparent to one skilled in the art after having had the benefit of studying the teachings of the specification, the drawings, and the claims, and that such other modifications may be made without departing from the spirit and scope of the invention.

What I claim is:

1. A swimming pool lounge chair comprising:

tubular frame further comprising a base portion, seat portion, and a back portion;

said base portion further comprising at least two telescoping legs to rest on the swimming pool structure in which said chair is utilized;

said seat portion including a generally horizontally extending seating member further comprising an adjustment mechanism to recline said back portion to a desired position; and said back portion further comprising an adjustable, telescoping pool perimeter mounting portion.

2. The swimming pool lounge chair of claim 1 wherein said chair is collapsible to make for easy portability and storage.

3. A swimming pool lounge chair adapted to be at least partially submerged in the water of a swimming pool comprising:

a frame constructed of a plurality of tubular members and including a base portion adapted to support said chair on a bottom of said swimming pool comprising a plurality of adjustable legs which may be extended or retracted as appropriate and an adjustable pool perimeter mounting portion adapted to support the upper portion of said chair at a perimeter of said swimming pool, said base portion and said pool perimeter mounting portion combining to support said chair in a stationary position within said swimming pool and to adjust the depth at which said chair is submerged within said water of said swimming pool; and a seating portion including a generally vertically extending back support portion and a generally horizontally extending seating portion, said back support portion being reclinable through a plurality of inclined positions; said chair being readily removable from said swimming pool and convertible into a collapsed configuration.

4. The swimming pool lounge chair of claim 3 further comprising a bumper spacer to maintain said chair at a particular distance from the pool wall.

5. The swimming pool lounge chair of claim 3 further comprising lower support members to provide said chair frame with increased strength.

6. The swimming pool lounge chair of claim 3 further comprising rubber tips to protect the exposed ends of said legs and to provide non-marking frictional contact between the adjustable legs and the swimming pool wall.

7. The adjustable pool perimeter mounting portion of claim 3 further comprising telescoping segments.

8. The adjustable pool perimeter mounting portion of claim 3 further comprising a friction material to make contact with the pool perimeter when said pool perimeter mounting portion is set in-place.

* * * * *